US005088398A

United States Patent [19]

Bielfeldt

[11] Patent Number: 5,088,398

[45] Date of Patent: Feb. 18, 1992

[54] CONTINUOUSLY WORKING PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 514,028

[22] Filed: Apr. 27, 1990

[30] Foreign Application Priority Data

Apr. 27, 1989 [DE] Fed. Rep. of Germany ..... 3913991

[51] Int. Cl.[5] ..... B30B 5/06

[52] U.S. Cl. ..... 100/154; 100/151; 100/153; 425/371

[58] Field of Search ..... 100/93 RP, 151, 153, 100/154; 425/371

[56] References Cited

U.S. PATENT DOCUMENTS

| | | | |
|---|---|---|---|
| 3,005,230 | 10/1961 | Hutter . | |
| 3,723,230 | 3/1973 | Troutner | 100/153 X |
| 4,417,866 | 11/1983 | Sitzler . | |
| 4,449,448 | 5/1984 | Stabler et al. . | |
| 4,613,293 | 9/1986 | Gerhardt | 425/371 |
| 4,621,999 | 11/1986 | Gerhardt | 425/371 |
| 4,671,760 | 6/1987 | Hayashi | 425/371 X |
| 4,718,843 | 1/1988 | Carlsson et al. | 100/154 X |
| 4,748,907 | 6/1988 | Schermutzki | 425/371 X |
| 4,807,525 | 2/1989 | de Brock | 100/153 |
| 4,921,418 | 5/1990 | Bielfeldt | 425/371 |
| 4,923,384 | 5/1990 | Gerhardt | 100/154 X |

FOREIGN PATENT DOCUMENTS

| | | | |
|---|---|---|---|
| 1717458 | 2/1956 | Fed. Rep. of Germany . | |
| 2059457 | 6/1972 | Fed. Rep. of Germany . | |
| 2215618 | 10/1973 | Fed. Rep. of Germany . | |
| 3117778 | 11/1982 | Fed. Rep. of Germany . | |
| 3140548 | 3/1983 | Fed. Rep. of Germany . | |
| 3312856 | 10/1984 | Fed. Rep. of Germany | 425/371 |
| 3743664 | 7/1989 | Fed. Rep. of Germany . | |
| 327433 | 3/1958 | Switzerland . | |

*Primary Examiner*—Harvey C. Hornsby
*Assistant Examiner*—Stephen F. Gerrity
*Attorney, Agent, or Firm*—Foley & Lardner

[57] ABSTRACT

A continuously working press is provided wherein steel bands of at least 2 mm thickness are used, and the roller bars have a diameter of at least 20 mm, preferably 21 mm. The roller bars, at the end faces thereof, are mounted in guide chains driven by entry sprockets. The entry and feed sprockets, which are fixed on the same axis, of the table and press ram are controlled in a synchronized manner and, in each case with the same radius, enclose both the roller bars as well as the link sleeves or the protective rollers in such a way that the center axes of the top and bottom roller bars are in alignment with one another in the pressure direction.

8 Claims, 5 Drawing Sheets

CONTINUOUSLY WORKING PRESS

BACKGROUND OF THE INVENTION

1. Field of the Invention

The present invention relates to a continuously working press for manufacturing chipboard, fiberboard, plywood panels or the like, and more particularly, to a continuously working press having flexible, endless steel bands which transmit applied pressure and draw the pressing material through the press.

2. Discussion of the Related Art

Continuously working presses are well known with art. Such presses typically include flexible steel bands, which are guided around a press table and a press ram via drive drums and deflection drums and, with an adjustable press gap, are supported against the abutment of table and press ram via travelling roller bars. The roller bars are guided with their axes oriented transversely to the band running direction and are positively guided at the entry into the press zone by feed sprockets.

For example, German Offenlegungsschrift 3,117,778 discloses a continuous press in which the rolling bodies revolving between the abutments and the steel bands consist of individual roller bars spanning the entire width of the press area. These roller bars, which can be two to three meters long, depending on the width of the press area, have a diameter of D of 14 to 18 mm, preferably 14 to 16 mm, at a tolerance of 15 μm and are guided free of cages or chains around the table and press ram. This dimensioning of the roller bars is based on the observation that the smaller the roller-bar diameter D—and thus the smaller the support spacing K—the greater the functional reliability of the rolling support of the roller bars relative to the steel band.

According to this dimensioning, the steel bands have a thickness d which approximately corresponds to the quotient D/10, the roller bars being fed into the press zone at a relative gap spacing s of approximately the thickness d of the steel bands. This dimensioning is intended to reduce the elastic deformation of the steel bands in the press zone. Deflection drums of unacceptably large diameter are avoided by selecting the steel-band thickness d to be below 1.8 mm.

In German Offenlegungsschrift 3,117,778, reference is made to the fact that congeneric devices having considerable elastic deformation (e.g. German Offenlegungsschrift 2,215,618), as well as slight elastic deformation (e.g. Swiss Patent Specification 327,433) have been disclosed which in each case involved considerable disadvantages, namely defective rectilinear exit of the roller bars. Based on these prior experiences, it was decided in German Offenlegungsschrift 3,117,778 to reduce the elastic deformation of the steel bands as far as possible. However, this is accompanied by the necessity, emphasized in German Offenlegungsschrift 3,117,778, of providing a very small production tolerance of 15 μm for the roller bars, which, of course, results in the manufacture of the roller bars becoming considerably more expensive.

The continuous press disclosed in German Offenlegungsschrift 3,117,778 is explicitly designed to provide a cage-free and chain-free guidance of the roller bars. Guide chains of this type are disclosed, for example, by Swiss Patent Specification 327,433. If the roller bars do not run exactly rectilinearly in presses of this type, considerable stresses occur in the chains, so that the chains can be destroyed. Obviously, this exact rectilinear exiting of the roller bars also cannot be guaranteed in the continuous press according to German Offenlegungsschrift 3,117,778. Thus, its roller bars are intended to run free of cages or chains.

However, satisfactory operation of the press according to German Offenlegungsschrift 3,117,778 with a cage-free and chain-free guidance of the roller bars has proven impossible. During start-up and idling operation or when the press ram is lifted, the frictional connection of the sagging steel band on the roller bars is neutralized and an indeterminate roller-bar spacing develops in the guidance-free roller-bar system, i.e. a random relative arrangement of the individual roller bars results. In particular, restarting in load operation is not possible without wear and malfunction, including roller-bar fracture.

A further disadvantage of the known press is that the use of steel-band thicknesses of $d=1.1$ to 1.8 mm limits the applied pressure to be transformed in practice to a value which is inadequate for certain requirements, e.g. for presses of 40 bar applied pressure and at press lengths over 40 m for manufacturing highly compressed chipboard panels of highest quality.

SUMMARY OF THE INVENTION

Accordingly, it is an object of the invention to provide a continuously working press which is operable with larger applied pressures, longer press lengths and, thus, higher feed-through speed for the pressing material, thereby yielding a higher output.

A further object of the present invention is to provide a press in which the roller bars in the press zone are reliably driven by the steel bands.

Yet another object of the invention is to provide a press in which idling and restarting operations are also possible without undue wear.

Still a further object of the present invention is to provide a continuously working press in which satisfactory operation is reliably guaranteed even at roller-bar diameters D of over 20 mm and a plus/minus tolerance greater than 15 μm.

The foregoing and additional objects are achieved, according to the present invention, when, if steel bands of at least 2 mm thickness are used, the roller bars have a diameter of at least 20 mm, preferably 21 mm. The roller bars, at the end faces thereof, are mounted in guide chains driven by entry sprockets. The entry and feed sprockets, which are fixed on the same axis, of the table and press ram are controlled in a synchronized manner and, in each case with the same radius, enclose both the roller bars as well as the link sleeves or the protective rollers in such a way that the center axes of the top and bottom roller bars are in alignment with one another in the pressure direction.

It has proven to be a surprising result of the invention that, when the guide chains and the feed sprockets feed the roller bars exactly orthogonally in the entry tangent and guide the bars further orthogonally into the press zone, the bars can then be unguided if the driving speed V/2 of the roller bars at the center point of the roller bars is ensured by the steel band. Only in this way is an identical gap spacing s between the roller bars always guaranteed. However, this works only because the elastic deformation of the steel band over the support spacing $K \approx 2D+2s$, wherein D is the roller-bar diameter and s standing for the spacing between the roller bars.

As a result of this, even roller bars of smaller diameter have adequate contact with the steel band and are thereby always reliably driven along.

Because of the diametral increase, compared with the known continuous press (over 20 mm, and preferably 21 mm), a spacing in the support is obtained between two roller bars, which enclose a further roller bar between them, which spacing is provided by the two outer roller bars of the relevant steel band. At this spacing the steel band, in the event of a reduction in diameter in the roller bar lying in between within a tolerance range of up to 30 μm, can still deflect to such an extent that the band reaches this roller bar of reduced diameter and thereby also reliably drives it along over the entire length of the press zone. As a result, the roller bars maintain their spacing very accurately in the press zone, so that they can be guided by chains without these chains being subjected to particularly high stresses.

The guidance of the roller bars by the guide chains and the feeding of the roller bars into the press zone at the same radius ensures that the roller bars and the guide chain are fed into the press zone at the same secant and arc measure of the entry tangent at exactly the same spacing s. Also associated with this is accurate control and synchronizing of the revolution of the top and bottom entry and feed sprockets so that the roller bars of the top and bottom roller-bar carpet are aligned along their center axes in the pressure direction. Flexing work, which wears the steel bands, is thus avoided. As a result, the applied pressure on the material to be pressed can thus be increased.

In addition, it should also be emphasized that only a roller-bar system positively guided by guide chains can be synchronized in the rolling press zone during changeover from idling to load operation.

As a further advantage of the measures according to the invention, it can be stated—and strength calculations for the roller bars have completely proved this—that the permissible tolerance increases with increasing roller-bar diameter D. In other words, the permissible tolerance is at least 30 μm, for example, at a roller-bar diameter of 21 mm, an applied pressure of 40 bar and a steel-band thickness of 2 mm. It can be assumed here that the torsional stress T increases with increasing rolling distance (≈ press length), since it is a result of the number of revolutions completed per press length.

The dimensioning provided for the roller bars and of the steel-band thickness and the gap spacing of the roller bars is surprisingly confirmed by strength and torsional-stress calculations and in practice, greater functional reliability of the roller-bar passage through the press being achieved by resilience of the roller bars.

The present invention thus shows that, with due regard to the permissible torsional fatigue strength, the restoring moment (resilience) and thus the functional reliability increase as roller-bar diameter increases. Also, when a higher-alloy material is used (instead of CK 55, e.g. 42 CrMo 4), there is reliable resilience at 21 mm diameter irrespective of the tolerance value even under the high applied pressures of about 50 bar typically used today. In this case, the length of the press table could even be infinite. This automatic resilience of the roller bars is obtained on account of a sufficiently high restoring moment in the permissible torsional fatigue strength range of about 3000 kN m.

As follows from the above, the plus/minus tolerance of the roller-bar diameter is no longer as important for roller bars of over 20 mm diameter as it is for diameters below 18 mm; i.e., within the scope of the invention, they no longer need this high priority and can be manufactured substantially cheaper.

Surprisingly, it has also been recognized that, in higher-alloy roller bars of larger diameter greater than or equal to 20 mm, inhomogeneity occurs in the alloy distribution which can take effect through increased residual stresses and can be compensated by a higher inherent strength; i.e. roller bars with higher torsional strength, a steel with greater carbon and nickel content of at least 0.1% being used with a chrome-molybdenum portion, can thus be advantageously manufactured from 20 mm up. The addition of carbon is advantageous in view of the surface hardening required and the addition of nickel for increasing the corrosion resistance while minimizing the formation of surface cracks and thus prolonging life through less wear. In a preferred embodiment, the roller bars are formed of a chrome-molybdenum alloy having at least a 3% carbon content.

However, even irrespective of the automatic resilience of the higher-alloy roller bars, e.g. for 42 CrMo 4 with higher permissible torsional stress, the following example is calculated for a roller bar: In roller bars of 21 mm diameter and a gap spacing of s = 1.5 mm, the roller-bar support spacing between a total of two roller bars equals 45 mm. The permissible torsional strain for this at 4 bar applied pressure is 35 μm in the exiting press zone of the press and at 40 bar is even 70 μm at the entry.

A further point in favor of the use of roller bars having a diameter of over 20 mm is that only for this size can link plates be dimensioned to be sufficiently robust so that the guide chain can fulfil its function. This is because, at D/2 less half the diameter of the centering pins plus the thickness of the link sleeves, there must be sufficient space between the center axis X-X of the roller bars and the steel band for the linkplate thickness without them rubbing on the steel band. To completely avoid rubbing on the steel bands, travel rollers having the same diameter as the roller bars are conveniently attached to the link sleeves of the guide chain.

The increase in the steel band thickness d to over 2.0 mm is also advantageous, since it is critical for a higher applied pressure and as a function thereof permits a longer press length. Therefore, the feedthrough of the material to be pressed increases at higher press speed; i.e., at steel band thicknesses of over 2.0 mm, either a higher applied pressure is possible or a longer press can be realized. In effect, either an increase in quality with adequate applied pressure or a greater feedthrough of material to be pressed in a longer press can be achieved in the process, since the passage velocity v can be greater in accordance with the steel bands.

A further advantage is that, because of the greater support spacing between the roller bars, a greater tolerance deviation in the range between 30 and 35 μm is permissible. As a result, the elastic deformation of the steel band over the entire length of the press table ensures uniform rolling at uniform roller-bar spacing. Consequently, close roller-bar spacings in the range 0.5–1.5 mm are possible irrespective of the roller-bar diameter and/or the steel band thickness. For safety reasons, however, a gap spacing of 1.5 mm is provided between the roller bars on account of different production tolerances and different extensions of the guide chains, as well as on account of different extensions of individual link plates and links during the life of the guide chain.

As a further advantage, the elastic and central mounting of the roller bars in the guide chains and also their reliable orthogonal feed by means of the feed sprockets permit satisfactory running of the roller bars in the press zone in both load operation and also in idling and start-up operation. The press according to the invention thus contains an advantageous concept for a coaxially guided system between guide chain and roller bar, as a result of which the same roller-bar spacing is always ensured at the entry of the feed tangent as well as in the horizontal press zone. The guide chains and roller bars are coupled to one another via the centering pin of the hollow-chain construction. This centering pin is at the same time designed as a bending bar so that during the load operation small synchronous-running errors between steel band and guide chain are automatically compensated.

DETAILED DESCRIPTION OF THE PREFERRED EMBODIMENTS

Figure 5:
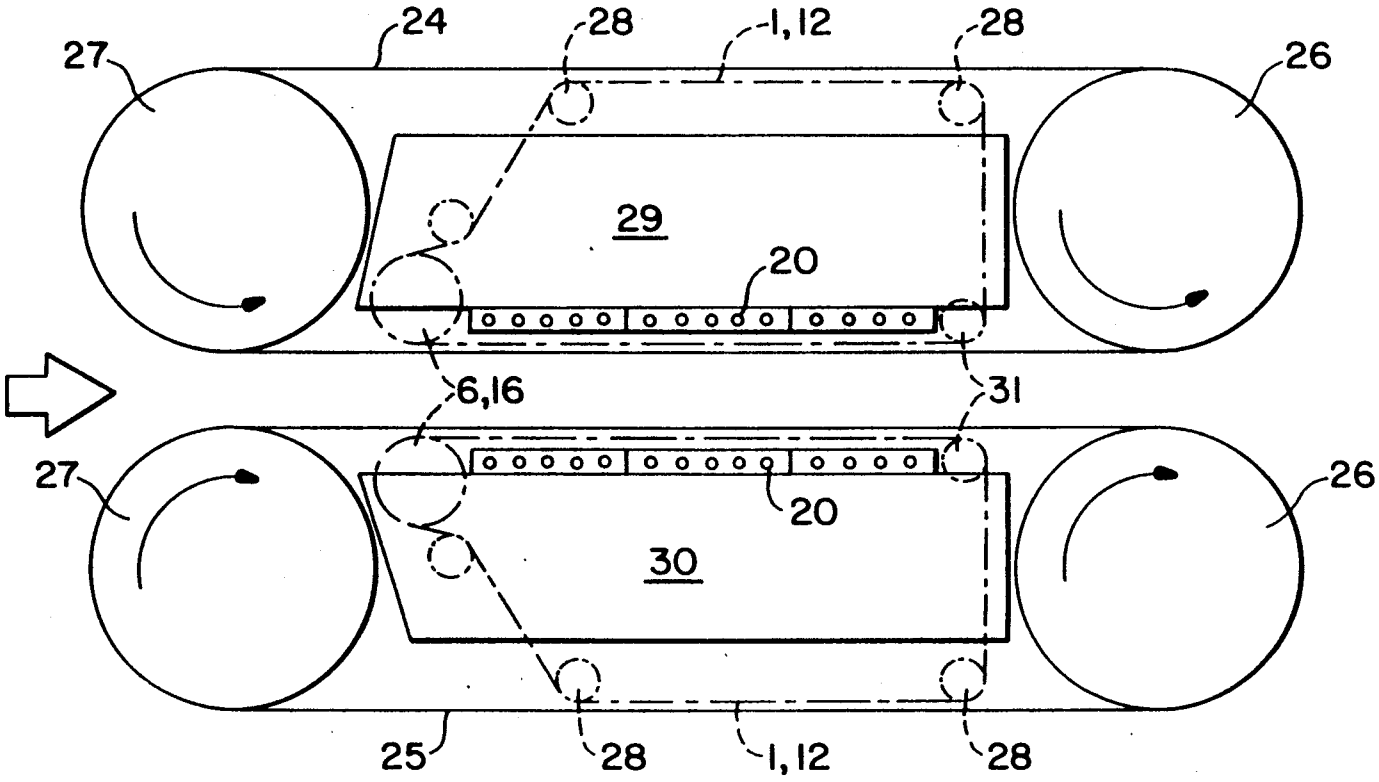
FIG. 5, in a schematic representation, is the press according to the invention in side view.

According to FIG. 5, the present invention contemplates a continuous press having a press table 30 and a moveable press ram connected by draw columns (not shown). To set the press gap, the press ram 29 is moved up and down by hydraulic piston-cylinder arrangements (not shown) and locked in a predetermined position. Steel bands 24 and 25 are each guided by a drive drum 26 and deflection drum 27 around press table 30 and press ram 29. To reduce friction between heating plates 20 (attached to the press table 30 and press ram 29) and the revolving steel bands 24 and 25, a roller-bar carpet, formed from roller bars 1 and likewise revolving, is provided for each half of the press. The roller bars 1, having axes extending transversely (in the direction of the arrow in FIG. 5) to the passage direction of the bands 24,25, are linked together at a predetermined pitch on both longitudinal sides of the press in the link eyes of a guide chain 12 and, at the heating plates 20 of press ram 29 and press table 30, as well as at the steel bands 24 and 25, are guided through the press so as to roll on the steel bands.

Figure 1:
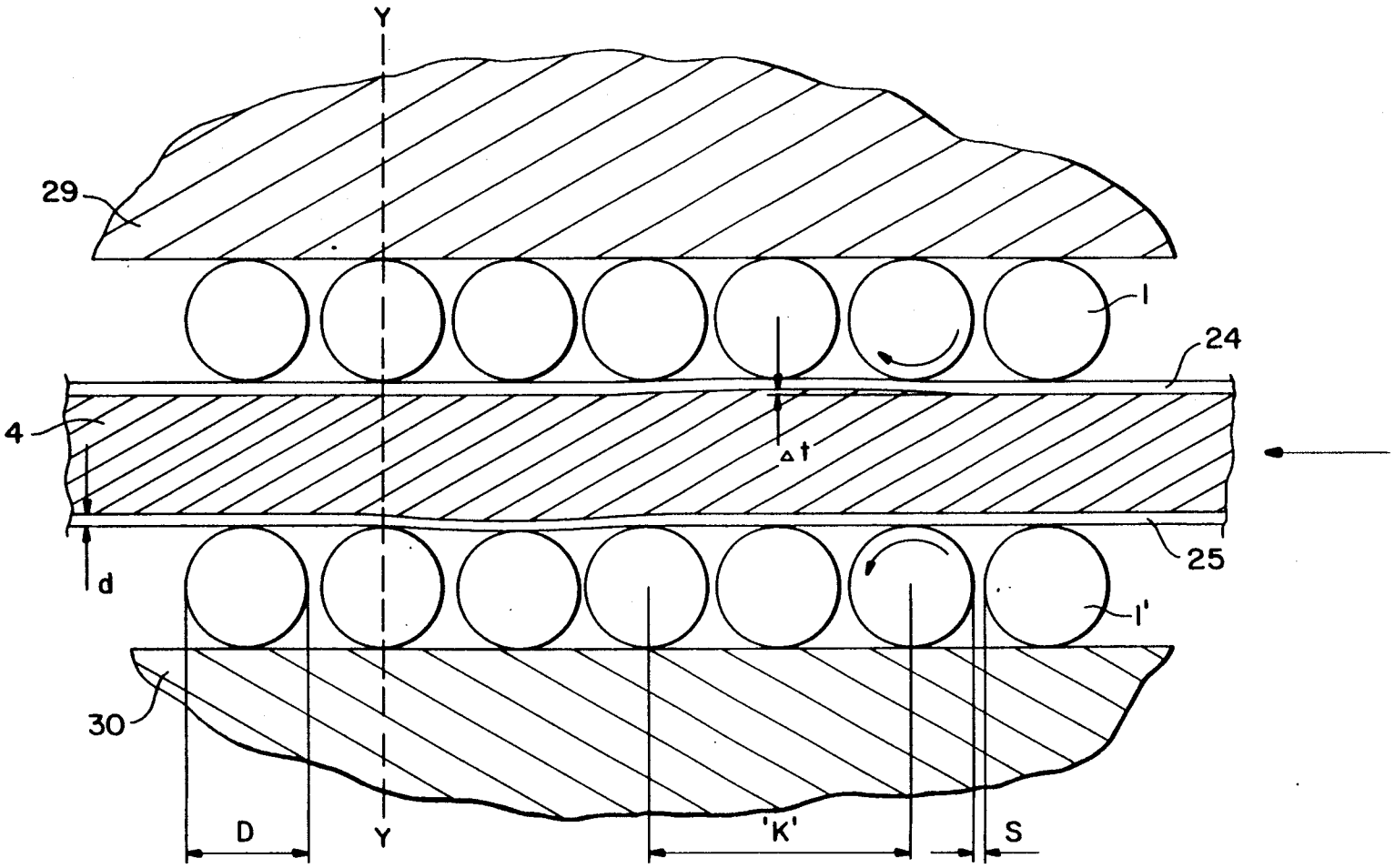
FIG. 1 is a side representation of the press zone with the roller bars and the steel bands between the press ram and press table.

FIG. 1 shows in full size the top roller bars 1 rolling on the press ram 29 and the bottom roller bars 1' rolling on the press table 30, the steel bands 24 and 25 driving the roller bars 1 and 1' along at a speed V/2 and in the process drawing the pressing material 4 through the press gap. In the preferred embodiment of the invention, the roller bars have a diameter D of 21 mm, while the steel bands 24 and 25 have a thickness d of 2 mm. Moreover, bands having a thickness of 2 mm can be provided to enable the realization of a higher pressure or a longer press. The roller bars 1 and 1' in the top and bottom plane are fed at a preferred spacing s of 1.5 mm into the press zone by the feed sprockets 16 (FIGS. 3 and 4) and in the process are synchronously controlled in such a way that each of the roller bars 1 and 1' lying opposite one another are in alignment with one another with their center axes in the pressure direction Y-Y. By the desired elastic deformation of the steel bands 24 and 25, such roller bars 1 and 1', which have a diameter D smaller by the difference t, are also driven along at V/2. K shows the support spacing $\approx 2D+2s$ with which each roller bar 1 and 1' is supported by two adjacent roller bars via the steel bands 24 and 25.

The fastening of the roller bars 1 in the guide chain 12 is subjected to heavy stressing in the face of the high applied pressure to be transmitted on the pressing material which is passing through the press. Therefore, a precondition for frictionless press operation is that linear displacements in the transporting direction of the roller bars 1,1' in the press zone must not result in destruction of the guide chains 12. For this, adequate compensating flexibility in the press zone between the roller bars 1 and the guide chain 12 with two degrees of freedom (X-Y axes) is critical. So that excessive linear displacement cannot occur in the press zone, an accurate orthogonal feed of the roller bars 1 in the entry arc and in the tangential transition into the horizontal press plane is necessary.

Figure 2:
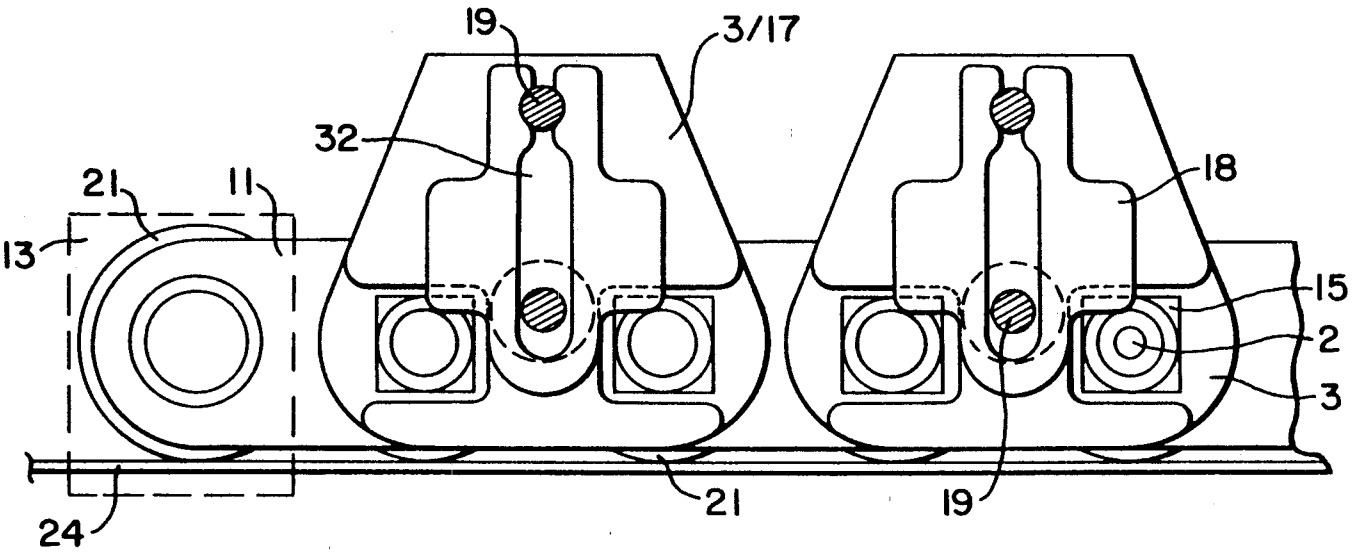
FIG. 2 is a partial view of the guide chain with roller bars with a top steel band.
Figure 3:
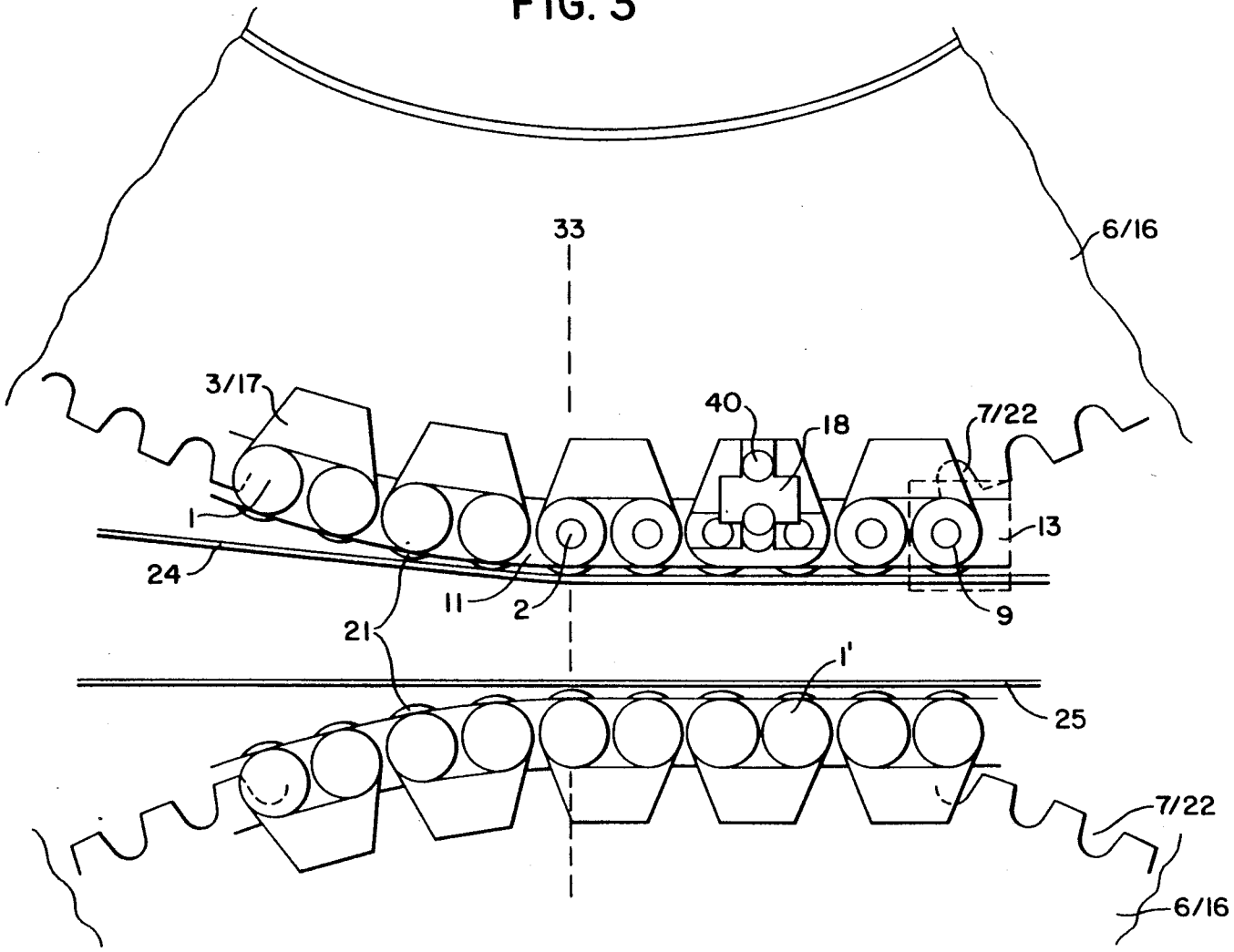
FIG. 3 is a partial side view of the top and bottom guide chains with roller bars in the entry arc.
Figure 4:
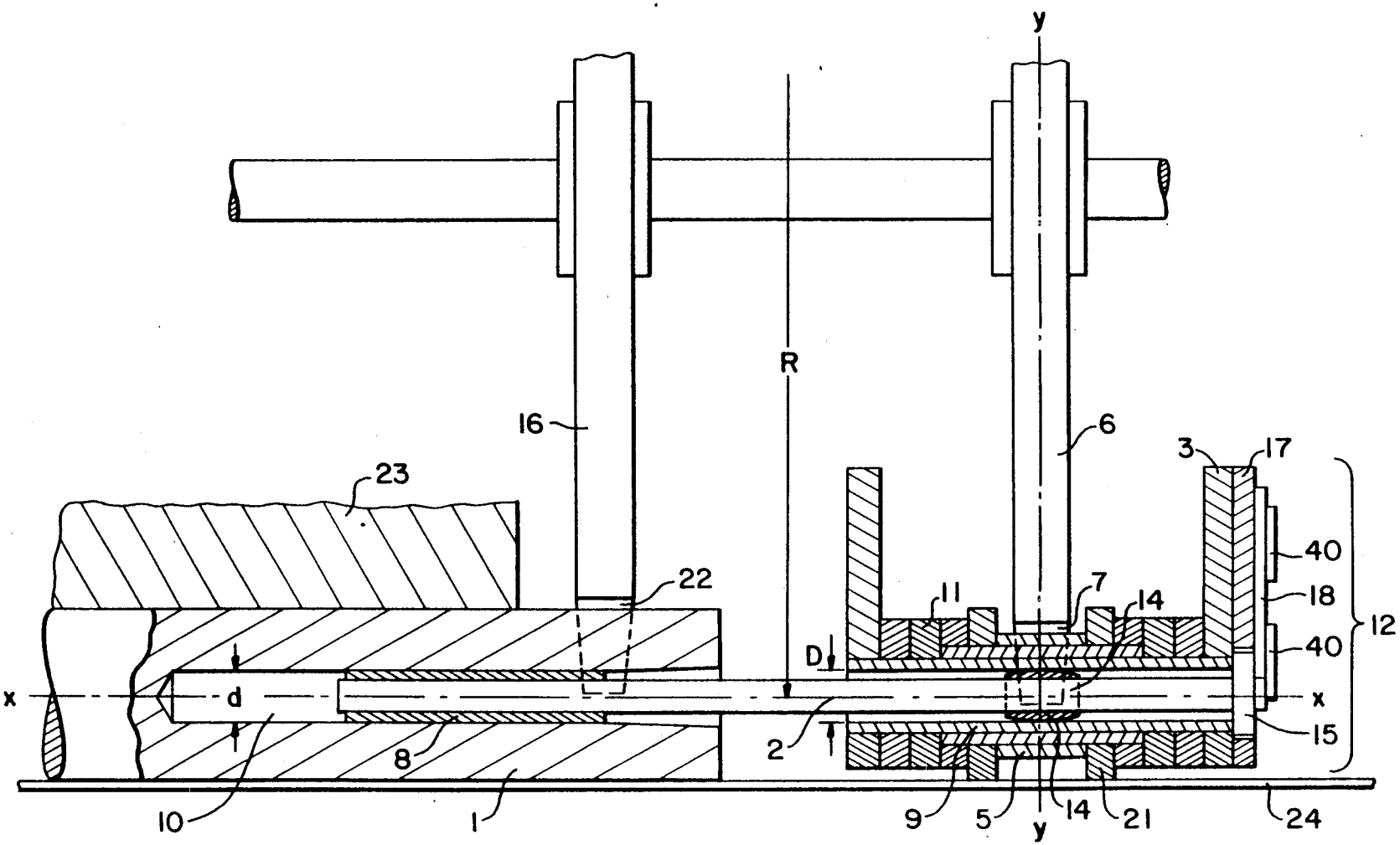
FIG. 4 is a partial front view of a guide chain with a roller bar in the entry arc.

As shown in FIGS. 2 to 4, provision is made to pass the forces emanating from the roller bars 1 into the links 13 of the guide chain via flexible centering pins 2. Thus, the spring forces of the centering pins 2 are absorbed centrally in the link sleeve 9 of the guide chain 12 via a spherical bearing sleeve 14. Deviations from the pitch during the rolling movement of the roller bars 1 in the press zone are absorbed in a compensating manner by the flexible centering pins 2 made of spring steel and cannot result in the destruction of the guide chain 12.

Furthermore, for each revolving roller-bar carpet of press ram 29 and press table 30, provision is made for the roller bars 1, by a plurality of feed sprockets 16, and for the guide chains 12, by two entry sprockets 6 arranged to the side of the entry heating plate 23, to be positively guided into the horizontal press plane at the same radius R with the same arc and secant measure in the entry arc and in the tangential transition. The feed sprockets 16 and entry sprockets 6 are arranged on one axis, and the roller bars 1 and the links 13 of the guide chain 12, with their center axes, are in alignment on a common axis X-X. The center spacing of the roller bars 1 and the guide chain 12 is thus always the same on the radius R of the feed sprockets 16 and the entry sprockets 6 and also does not change at the transition tangent to the horizontal press plane. Thus absolutely exact control of the roller bars 1 in the entry arc is possible, as is accurate orthogonal alignment of the roller bars 1 into the compression zone.

Due to the compact arrangement of the linkplate sets 3 and 11 in the guide chain 12 constructed as a sleeve-type chain, the guide chain has an exceptionally strong supporting effect in the transporting direction. The centering pins 2 are provided with a spherical bearing sleeve 14 in such a way that they pass the spring force exactly centrally into the link sleeve 9, while at the other end they are rotatably mounted in a bore 10 of the roller bars 1 by means of a rotary sleeve 8, and the roller bars 1 are mounted in an axially displaceable manner on centering pins 2. The radial and axial movements of the roller bars 1 are thereby absorbed in such a way as to be compensatingly guided.

In order to arrange the centering pins 2 in the guide chain 12 in such a way that they are prevented from rotating and are interchangeable, they are provided at their outer end with square pressed-on sleeves 15. As a locating means for the square pressed-on sleeves 15, stop plates 17 are fixed to the enlarged outer link plates 3 or 36 in such a way that their bottom edge bears against the square pressed-on sleeves 15 and thus secures them (and thus also the centering pins 2) so as to prevent them from rotating. For alignment and to prevent the centering pins 2 from shifting, two clamping bolts 19 each are fixed in the outer link plates 3 and the stop plates 17, on which clamping bolts 19 the locking plates 18 with clamping slot 32, are to be held in place in a clamping but detachable manner. The disk 40 (FIGS. 3 and 4) prevents the locking plate 18 from becoming detached from the clamping bolt 19.

At the longitudinal margins of the steel bands 24 and 25, undulations tend to occur which are caused by thermal stresses. The link plates 3 and 11 of the guide chains can rub on these undulations and wear out prematurely. Travel rollers 21 provided on the link sleeves 9 of the guide chains 12 and having the same diameter as the roller bars 1 are intended to prevent this premature wear.

The design of the guide chain 12 and the tangential transition from the entry arc into the horizontal press plane is illustrated in FIG. 3.

It is further revealed in FIGS. 2 to 4 how the protective rollers 5 are guided by the recesses 7 of the entry sprockets 6 and how the roller bars 1 are guided by the recesses 22 of the feed sprockets 16. The roller-bar revolution via the deflection wheels 28 and 31 is shown in FIG. 5.

It should become obvious that the present invention is not limited to the preferred embodiments shown and described.

What is claimed is:

1. A continuously working press, comprising:

a table member;

a press member disposed thereover defining a horizontal pressing plane therebetween;

first and second flexible bands disposed about said table member and press member, respectively;

means for rotating said bands about said table member and press member, respectively;

a roller rod assembly disposed between each of said table member and said first flexible band and said press member and said second flexible band, respectively;

each of said roller rod assemblies comprising:

1) a plurality of roller rods extending transversely of the direction of rotation of said flexible bands;

2) a guide chain assembly, including a guide chain, connected to said roller rods and extending beyond the pressing plane, said guide chain assembly aligning center axes of roller rods corresponding to said first flexible band with those of said second flexible band in a pressing direction of the press; and 3) means for force-guiding said roller rods and said guide chain assembly onto said horizontal pressing plane with the same arc and secant dimensions as the path of said roller rods;

wherein said flexible bands each have a thickness d which is greater than 2 mm and said roller rods each have a diameter D which is about d * 10 and which is greater than 20 mm.

2. The continuously working press as claimed in claim 1, wherein D equals about 21 mm.

3. The continuously working press as claimed in claim 1, wherein said force-guiding means guide said roller rods into the pressing plane with a spacing of 1.5 mm between successive roller rods.

4. The continuously working press as claimed in claim 3, wherein, for adequate surface hardness and to minimize wear, said roller rods are formed of a chrome-molybdenum-alloy having at least 0.3% carbon content.

5. The continuously working press as claimed in claim 4, wherein, to prolong life and increase corrosion resistance, said roller rods are formed of chrome-molybdenum-nickel steel enriched with at least 0.1% nickel content.

6. The continuously working press as claimed in claim 1, further comprising bearing pins which are disposed in links of said guide chain and in bores of said roller rods and which connect each end of each of said roller rods to said guide chain in an axially displaceable manner.

7. The continuously working press as claimed in claim 6, wherein said bearing pins are made of spring steel; and further comprising a bearing sleeve and a square pressed-on sleeve which are provided on a peripheral surface of each of said bearing pins and which mount said bearing pins centrally in guide sleeves of said guide chain.

8. The continuously working press as claimed in claim 7, further comprising travel rollers which are constructed with a diameter equal to the diameter D of said roller rods and which are attached to said guide sleeves.

* * * * *